US011791122B2

(12) United States Patent
Lee

(10) Patent No.: US 11,791,122 B2
(45) Date of Patent: Oct. 17, 2023

(54) CNT X-RAY SOURCE APPARATUS INCLUDING CATHODE ELECTRODE, EMITTER, GATE ELECTRODE, FOCUSING ELECTRODE AND BASE PORTION HAVING GROOVE FOR ACCOMMODATING CATHODE ELECTRODE

(71) Applicant: Han Sung Lee, Hwaseong-si (KR)

(72) Inventor: Han Sung Lee, Hwaseong-si (KR)

( * ) Notice: Subject to any disclaimer, the term of this patent is extended or adjusted under 35 U.S.C. 154(b) by 402 days.

(21) Appl. No.: 17/167,340

(22) Filed: Feb. 4, 2021

(65) Prior Publication Data

US 2022/0246383 A1 Aug. 4, 2022

(51) Int. Cl.
*H01J 35/06* (2006.01)
*H01J 35/16* (2006.01)

(52) U.S. Cl.
CPC ..... *H01J 35/065* (2013.01); *H01J 35/16* (2013.01); *H01J 2201/30469* (2013.01); *H01J 2235/062* (2013.01)

(58) Field of Classification Search
CPC ..... H01J 35/065; H01J 35/16
See application file for complete search history.

(56) References Cited

FOREIGN PATENT DOCUMENTS

| | | | | |
|---|---|---|---|---|
| CN | 109065428 A | * | 12/2018 | ..... H01J 19/24 |
| KR | 10-2015-0051820 A | | 5/2015 | |
| KR | 10-2015-0084321 A | | 7/2015 | |
| KR | 10-1701047 B1 | | 1/2017 | |
| KR | 10-1752997 B1 | | 7/2017 | |
| KR | 10-2018-0005880 A | | 1/2018 | |

* cited by examiner

*Primary Examiner* — Joseph L Williams
(74) *Attorney, Agent, or Firm* — Sughrue Mion, PLLC

(57) ABSTRACT

The present disclosure relates to a CNT X-ray source apparatus, and more particularly, to a CNT X-ray source apparatus configured to maximize utilization of the internal space of a CNT X-ray tube body, having grooves made of an insulating material, and provided with a base portion for supporting a plurality of electrodes. With this configuration, mass production is possible. The CNT X-ray source apparatus of the present disclosure includes a cathode electrode; an emitter provided on the cathode electrode and responsible for emitting electrons; a gate electrode disposed above the cathode electrode and spaced apart from the cathode electrode by a predetermined interval; a focusing electrode for preventing scattering of electrons emitted from the emitter; and a base portion responsible for supporting one or more of the cathode electrode, the gate electrode, and the focusing electrode and formed of an insulating material. In this case, one or more grooves for accommodating at least one of the cathode electrode, the gate electrode, and the focusing electrode are formed in the base portion.

17 Claims, 6 Drawing Sheets

【FIG. 1】
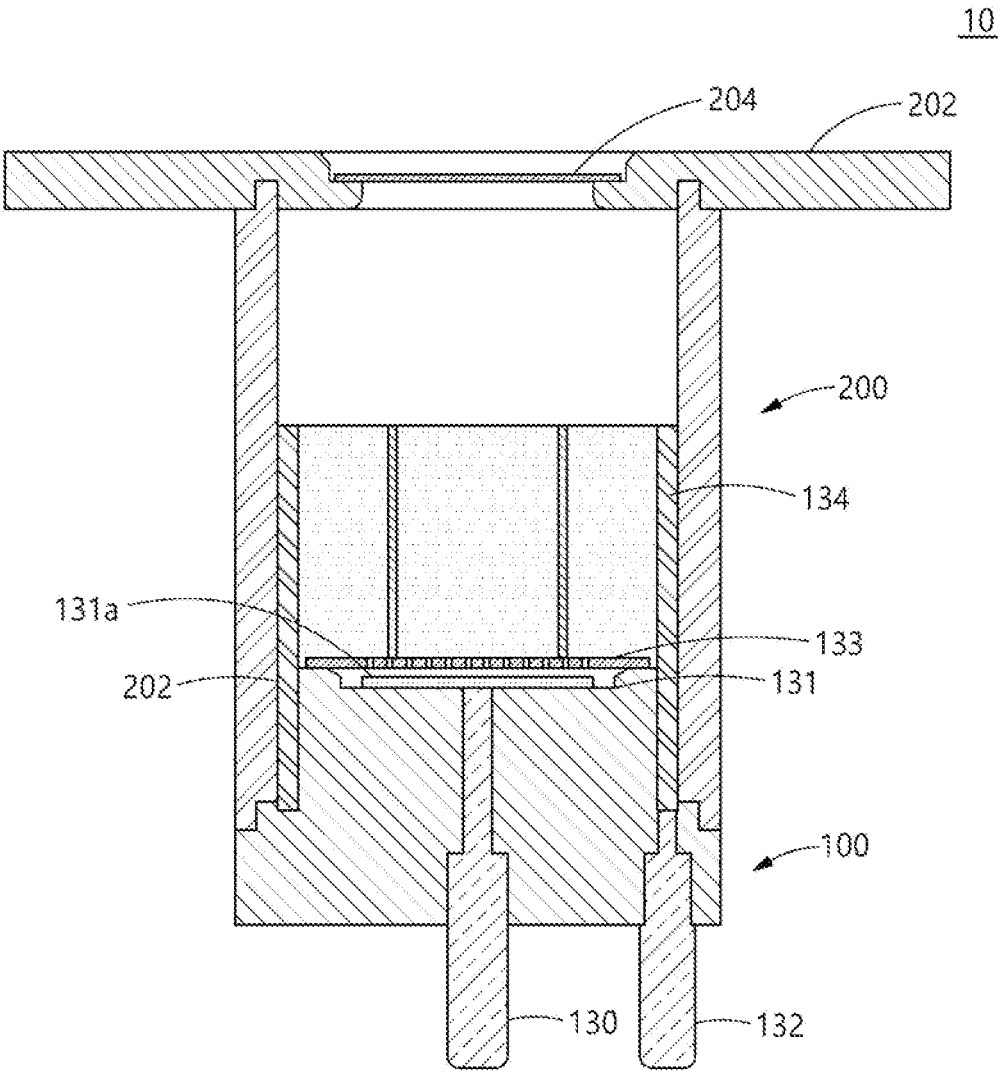

【FIG. 2】
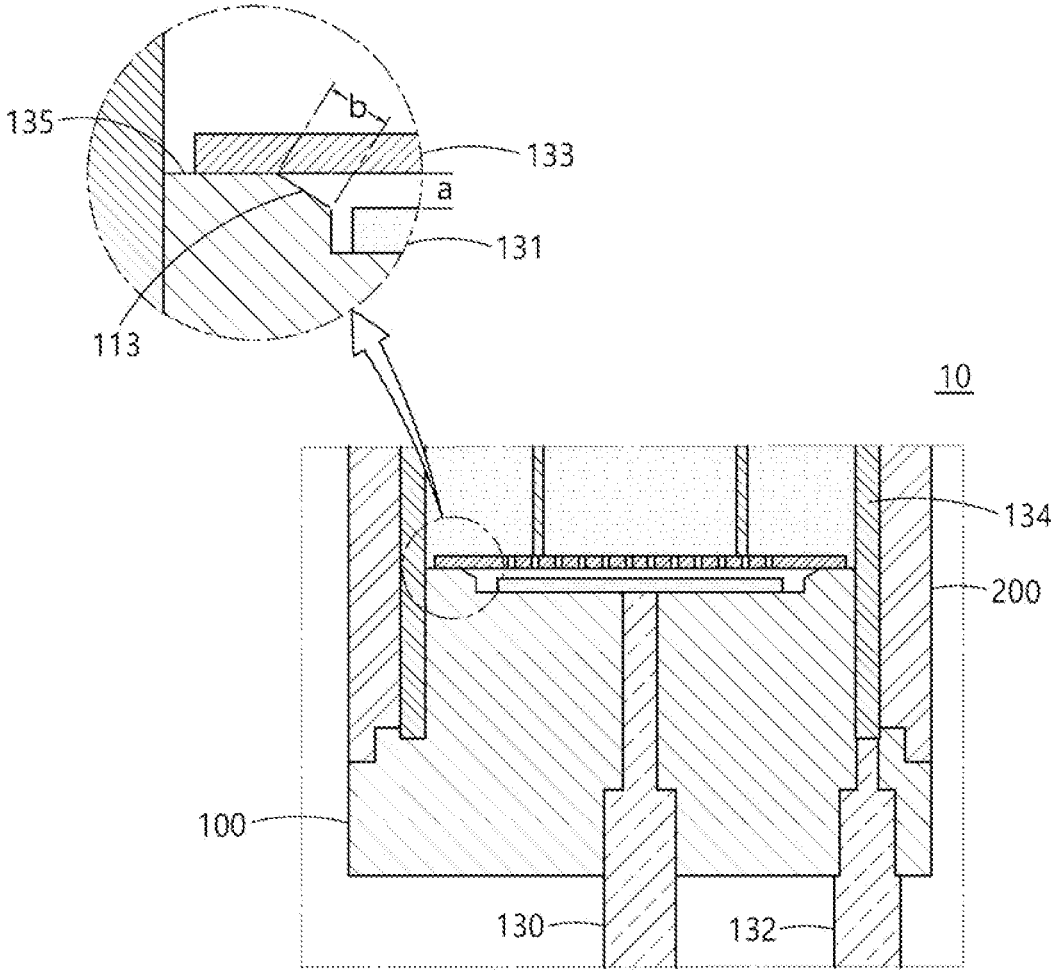

【FIG. 3】
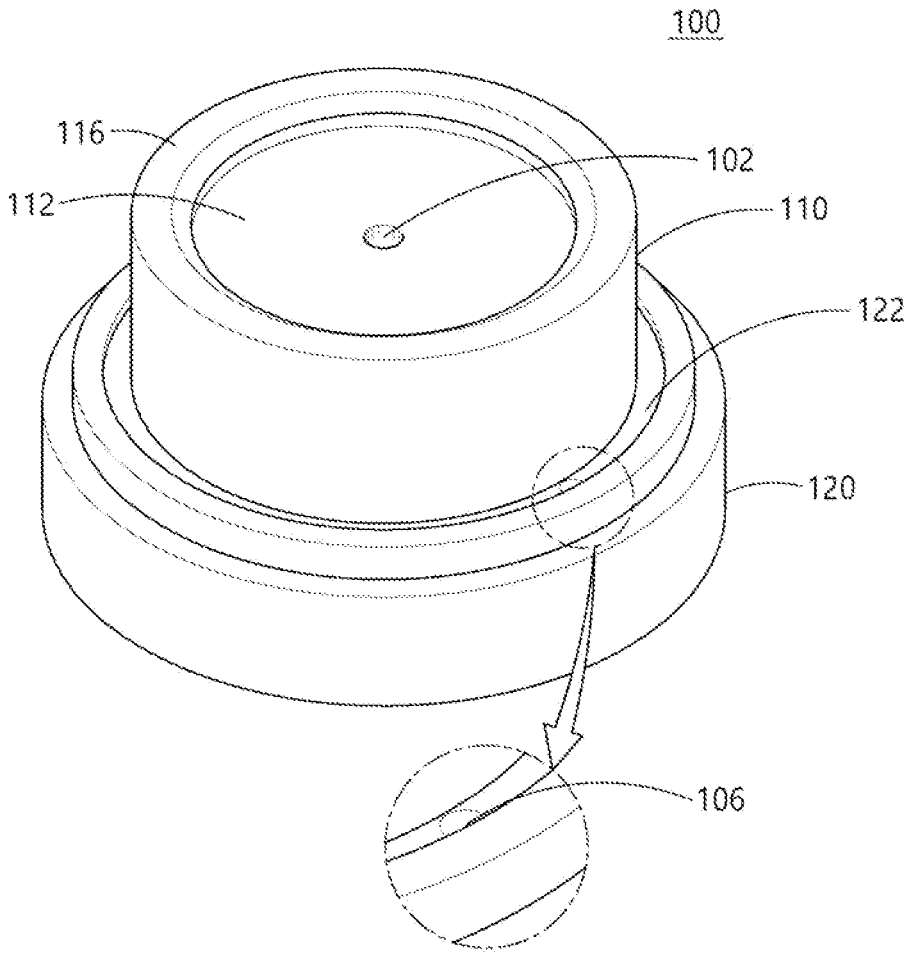

【FIG. 4】
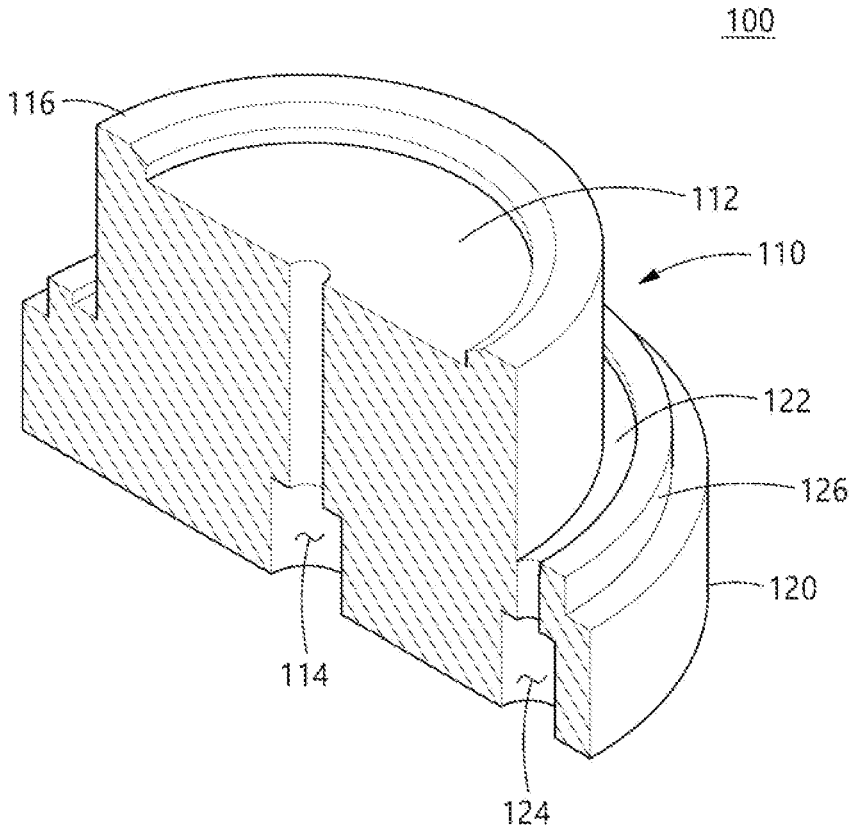

【FIG. 5】
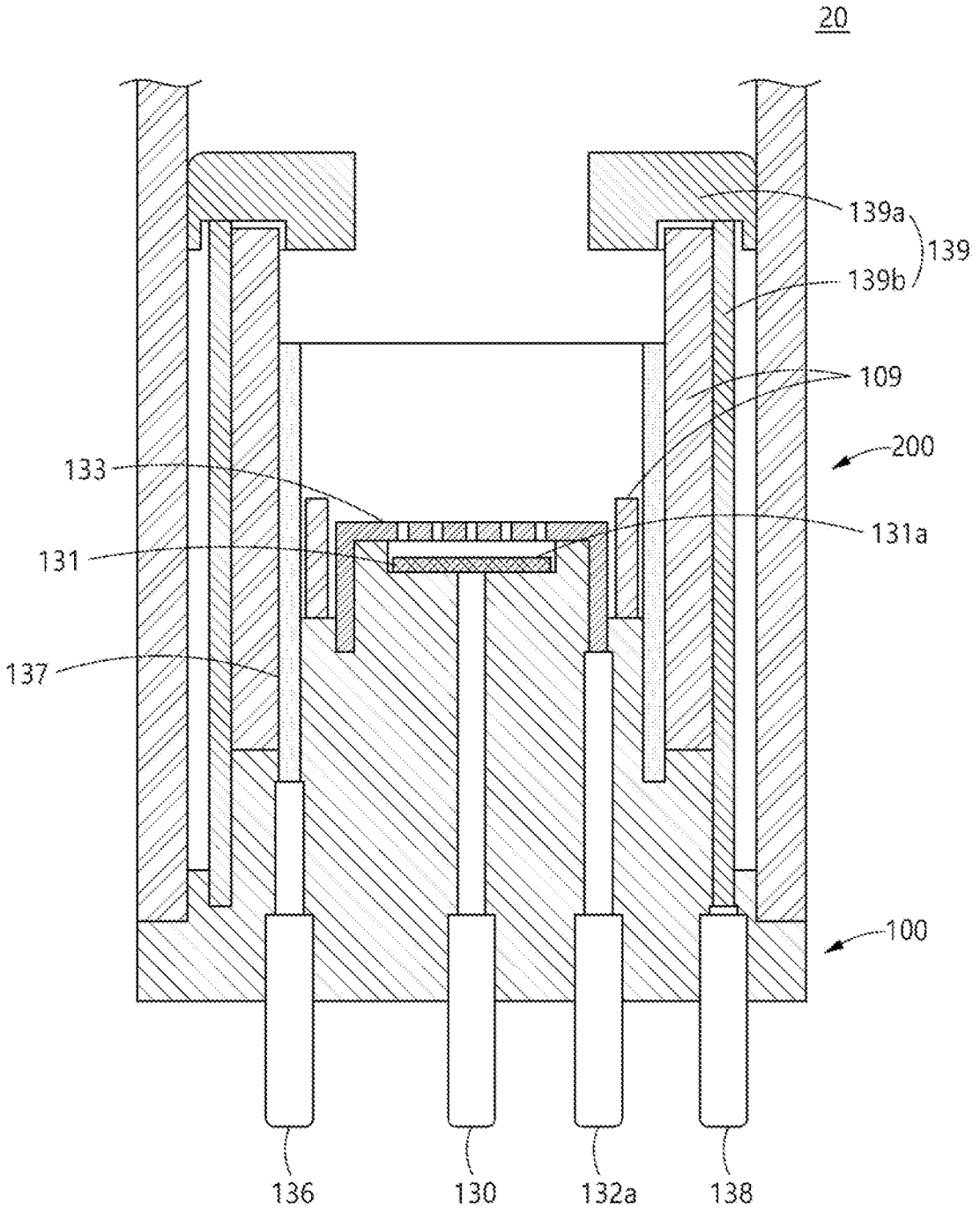

【FIG. 6】
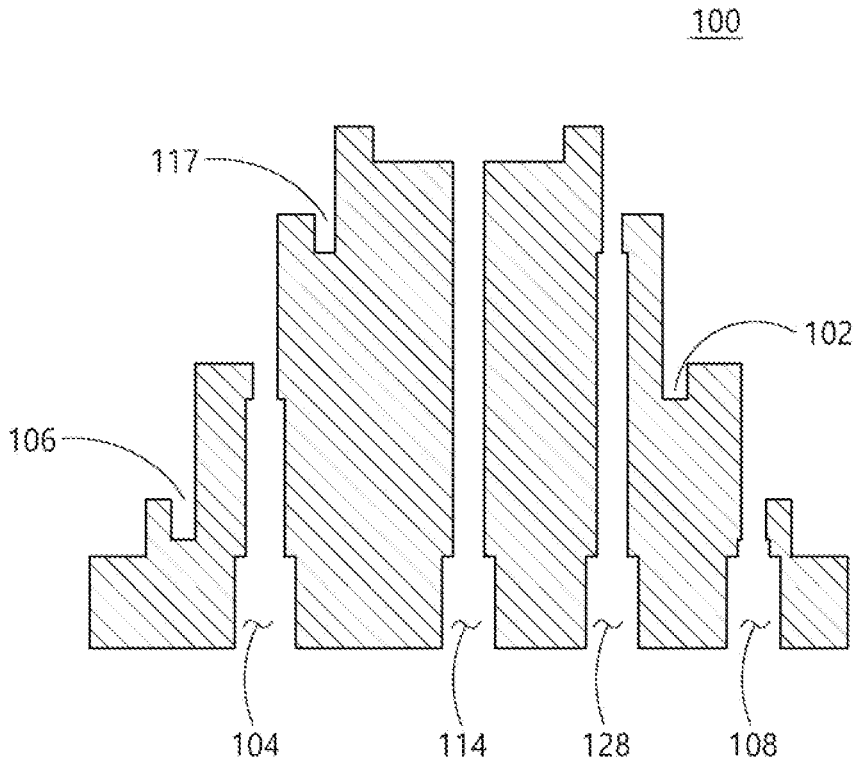

CNT X-RAY SOURCE APPARATUS INCLUDING CATHODE ELECTRODE, EMITTER, GATE ELECTRODE, FOCUSING ELECTRODE AND BASE PORTION HAVING GROOVE FOR ACCOMMODATING CATHODE ELECTRODE

BACKGROUND OF THE DISCLOSURE

Field of the Disclosure

The present disclosure relates to a CNT X-ray source apparatus, and more particularly, to a CNT X-ray source apparatus configured to maximize utilization of the internal space of a CNT X-ray tube body, having grooves made of an insulating material, and provided with a base portion for supporting a plurality of electrodes. With this configuration, mass production is possible.

Description of the Related Art

An X-ray source is an apparatus for generating X-rays, and includes an X-ray tube consisting of a vacuum tube, a cathode, and an anode, wherein the cathode and the anode are provided in the vacuum tube; a device for controlling and generating a high voltage to apply the high voltage to the X-ray tube; and a cooler for cooling heat generated in the X-ray tube.

In the case of an X-ray apparatus using a conventional X-ray source, electrons are emitted when an electron source such as a tungsten filament is heated to a high temperature, and the emitted electrons collide with a target. However, conventional X-ray sources have difficulty in instantaneous switching or current modulation, making digital driving difficult. In addition, conventional X-ray sources have disadvantages such as high power consumption, and have difficulty in energy distribution and direction of emitted electrons and electromagnetic focusing. In addition, such a thermal electron tube using a filament has problems such as a large size thereof and frequent failure due to use of a weak material such as glass.

Therefore, to overcome these problems, a cold electron X-ray tube using a nanomaterial such as CNT as a field emission source has been developed.

However, in the case of such a cold electron x-ray tube, it is difficult to secure a withstand voltage, and electron beam generating components are installed too complicatedly therein. In addition, since electrodes are exposed to the outside, there are problems such as poor insulation and poor usability.

RELATED ART DOCUMENTS

Patent Documents (Patent Document 1) Korean Patent No. 10-1701047 (Registration date: Jan. 23, 2017)

SUMMARY OF THE DISCLOSURE

Therefore, the present disclosure has been made in view of the above problems, and it is an object of the present disclosure to provide a CNT X-ray source apparatus including a base portion that supports a cathode and is formed of an insulating material and a plurality of grooves formed in the base portion so that electrodes are easily coupled to the base portion. With this configuration, production cost may be reduced, and productivity may be improved.

It is another object of the present disclosure to provide a CNT X-ray source apparatus configured to maximize utilization of the internal space thereof while maintaining the compact outer diameter thereof.

It is yet another object of the present disclosure to provide a structure that allows an external power source for supplying electricity to be easily connected to each electrode inside a vacuum packaged CNT X-ray source apparatus.

In accordance with one aspect of the present disclosure, provided is a CNT X-ray source apparatus including a cathode electrode; an emitter provided on the cathode electrode and responsible for emitting electrons; a gate electrode disposed above the cathode electrode and spaced apart from the cathode electrode by a predetermined interval; a focusing electrode for preventing scattering of electrons emitted from the emitter; and a base portion responsible for supporting one or more of the cathode electrode, the gate electrode, and the focusing electrode and formed of an insulating material, wherein one or more grooves for accommodating at least one of the cathode electrode, the gate electrode, and the focusing electrode are formed in the base portion.

Preferably, according to the present disclosure, feed-through holes through which electrodes for supplying electricity to at least one of the cathode electrode, the gate electrode, and the focusing electrode pass may be formed through the base portion.

Preferably, according to the present disclosure, on an upper part of the base portion, a cathode accommodation groove for accommodating the cathode electrode and supporting the emitter may be formed to be recessed.

Preferably, according to the present disclosure, a cathode feed-through hole penetrating to a bottom of the base portion may be formed on a bottom of the cathode accommodation groove, and a cathode power connector for supplying electricity to the cathode electrode may be connected through the cathode feed-through hole.

Preferably, according to the present disclosure, a gate support portion for supporting the gate electrode may be formed around the cathode accommodation groove to protrude from a bottom of the cathode accommodation groove, and an inclined surface may be formed between an inner surface of the cathode accommodation groove and the gate support portion.

Preferably, according to the present disclosure, the focusing electrode may be formed in a hollow cylindrical shape and may be formed to extend upward from the gate electrode.

Preferably, according to the present disclosure, the CNT X-ray source apparatus may further include an X-ray source body supported by the base portion, and the base portion may include a first body portion for supporting the cathode electrode and the gate electrode and a second body portion for supporting the focusing electrode and the source body, wherein the first body portion and the second body portion may be integrally formed.

Preferably, according to the present disclosure, a focusing electrode support groove into which at least a part of the focusing electrode is inserted may be formed on the second body portion, and a focusing feed-through hole may be formed through a bottom of the focusing electrode support groove.

Preferably, according to the present disclosure, the focusing electrode support groove may be formed in a ring shape surrounding the first body portion.

Preferably, according to the present disclosure, a focusing power connector for supplying electricity to the focusing electrode and the gate electrode may be connected through the focusing feed-through hole.

Preferably, according to the present disclosure, on one side of an upper part of the gate support portion, the gate electrode and the focusing electrode may be electrically connected to each other.

Preferably, according to the present disclosure, at least one short sill may be formed on the second body portion, and the X-ray source body may be coupled to the short sill.

Preferably, according to the present disclosure, the focusing electrode may include a first focusing electrode and a second focusing electrode provided outside the first focusing electrode, and a first focusing support groove for supporting the first focusing electrode and a second focusing support groove for supporting the second focusing electrode may be formed on the base portion.

Preferably, according to the present disclosure, partition walls made of an insulating material may be provided between the first focusing electrode and the second focusing electrode, a first focusing feed-through hole may be formed on a bottom of the first focusing electrode support groove, and a second focusing feed-through hole may be formed on a bottom of the second focusing electrode support groove.

Preferably, according to the present disclosure, the gate electrode may be formed in a hollow cylindrical shape, a ring-shaped gate support groove for supporting the gate electrode may be formed on the first body portion, and gate electrode feed-through holes may be formed on a bottom of the gate support groove for supporting the gate electrode.

Preferably, according to the present disclosure, at least a part of an outer circumferential surface of the base portion may be exposed to a part of a bottom of the CNT X-ray source apparatus and a lower part of a side surface of the CNT X-ray source apparatus.

In accordance with another aspect of the present disclosure, provided is a CNT X-ray source apparatus including a cathode electrode; an emitter provided on the cathode electrode and responsible for emitting electrons; a gate electrode disposed above the cathode electrode and spaced apart from the cathode electrode by a predetermined interval; a focusing electrode for preventing scattering of electrons emitted from the emitter; a base portion responsible for supporting one or more of the cathode electrode, the gate electrode, and the focusing electrode and formed of an insulating material; and an X-ray source body responsible for accommodating the cathode electrode, the emitter, the gate electrode, and the focusing electrode and supported by the base portion, wherein one or more feed-through holes for supplying electricity to at least one of the cathode electrode, the gate electrode, and the focusing electrode are formed on the base portion, and one or more short sills that facilitate engagement with the cathode electrode, the gate electrode, the focusing electrode, and the X-ray source body are formed on the base portion.

BRIEF DESCRIPTION OF THE DRAWINGS

The above and other objects, features and other advantages of the present disclosure will be more clearly understood from the following detailed description taken in conjunction with the accompanying drawings, in which:

FIG. 1 is a top view of a CNT X-ray source apparatus according to the present disclosure;

FIG. 2 illustrates a CNT X-ray source apparatus according to the present disclosure in detail;

FIG. 3 is a perspective view of the base portion of a CNT X-ray source apparatus according to the present disclosure;

FIG. 4 is a cross-sectional view of the base portion of a CNT X-ray source apparatus according to the present disclosure;

FIG. 5 is a cross-sectional view of a CNT X-ray source apparatus according to another embodiment of the present disclosure; and FIG. 6 is a cross-sectional view of the base portion of a CNT X-ray source apparatus according to another embodiment of the present disclosure.

DETAILED DESCRIPTION OF THE DISCLOSURE

Specific structural and functional descriptions of embodiments according to the concept of the present disclosure disclosed herein are merely illustrative for the purpose of explaining the embodiments according to the concept of the present disclosure. Furthermore, the embodiments according to the concept of the present disclosure can be implemented in various forms and the present disclosure is not limited to the embodiments described herein. In addition, the embodiments of the present disclosure include changes, equivalents, or alternatives falling within the spirit and scope of the present disclosure.

Hereinafter, the present disclosure will be described in detail with reference to the accompanying drawings.

FIG. 1 is a top view of a CNT X-ray source apparatus according to the present disclosure. A CNT X-ray source apparatus 10 according to one embodiment of the present disclosure is an apparatus for generating X-rays and may include a base portion 100 located at the bottom of the CNT X-ray source apparatus 10 and a CNT X-ray source body 200 configured to be supported by the base portion 100. In this case, the base portion 100 and the CNT X-ray source body 200 are coupled to each other.

In addition, the CNT X-ray source apparatus 10 according to this embodiment may include a cathode electrode 131, an emitter 131*a* provided on the cathode electrode 131 and responsible for emitting electrons, a gate electrode 133 disposed above the cathode electrode 131 and spaced apart from the cathode electrode 131 by a predetermined interval, and a focusing electrode 134 for preventing scattering of electrons emitted from the emitter 131*a*.

The base portion 100 may support one or more of the cathode electrode 131, the gate electrode 133, and the focusing electrode 134 and may be formed of an insulating material such as ceramics.

In addition, in the base portion 100, one or more grooves for accommodating at least one of the cathode electrode 131, the gate electrode 133, and the focusing electrode 134 may be formed.

In addition, feed-through holes 114 and 124 through which power connectors such as electric wires for supplying electricity to at least one of the cathode electrode 131, the gate electrode 133, and the focusing electrode 134 pass are formed through the base portion 100. The feed-through holes will be described in detail below.

The cathode electrode 131 is a negative (−) electrode and may be formed of an alloy such as nickel, iron, or cobalt or a transition metal so that the CNT X-ray source apparatus 10 may be easily operated in a vacuum state.

The emitter 131*a* for emitting electrons may be disposed on the cathode electrode 131 disposed on the base portion 100.

The emitter 131*a* includes a plurality of carbon nanotubes (CNTs) (not shown) for emitting electrons. When cathode power is applied to the cathode electrode 131, electrons are emitted from the carbon nanotubes deposited on the emitter 131*a*. Conductive materials including metals and carbon-based materials may be used as the emitter 131*a*.

The gate electrode 133 may be disposed above the base portion 100 and may extract electrons from the emitter 131*a* when power is applied to the gate electrode 133.

The gate electrode 133 may be positioned upward from the emitter 131*a* while being spaced apart from the emitter 131*a*, and may be formed of a relatively thin sheet or metal material. A through hole through which electrons emitted from the emitter 131*a* pass may be formed in the center of the gate electrode 133. A mesh formed of a metal material may be used to form the through hole, but the present disclosure is not limited thereto.

The focusing electrode 134 may be formed in various shapes, such as a hollow cylinder, an oval, and a rectangle, according to a focusing shape, and the shape thereof is not particularly limited. The focusing electrode 134 may be coupled to the base portion 100 and may be formed to be extended upward from the gate electrode 133.

When electrons emitted from the emitter 131*a* pass through the gate electrode 133 and electrons are extracted, the focusing electrode 134 serves to guide the extracted electrons to move in one direction without spreading or scattering.

The focusing electrode 134 may be formed in a hollow and relatively thin cylindrical shape as a case of focusing in a circular shape. Compared to a conventional case of laminating a focusing electrode on a cathode electrode and a gate electrode, internal space utilization may be maximized. Accordingly, a withstand voltage may be increased, and thus high current may be used and lifespan may be increased.

An anode electrode 202 disposed to face the cathode electrode 131 is positioned at the top of the CNT X-ray source body 200 and is further provided with a target 204 with which electrons emitted from the emitter 131*a* collide and emits X-rays.

When power is supplied to the CNT X-ray source apparatus 10, a high potential difference ranging from several kV to several hundred kV is formed between the cathode electrode 131 and the anode electrode 202. Accordingly, due to the potential difference between the cathode electrode 131 and the anode electrode 202, electrons emitted from the emitter 131*a* are accelerated toward the anode electrode 202, and the accelerated electrons collide with the target 204 to generate X-rays.

FIG. 2 illustrates a CNT X-ray source apparatus according to the present disclosure in detail.

A cathode accommodation groove 112 for accommodating the cathode electrode 131 may be formed on the base portion 100. To form a space in which the cathode electrode 131 is accommodated, the cathode accommodation groove 112 may be formed to be recessed by a predetermined depth. The cathode accommodation groove 112 may be formed in a shape corresponding to the cathode electrode 131. For example, when the cathode electrode 131 is formed in a circular shape, the cathode accommodation groove 112 may also be formed in a circular shape. However, for ease of coupling, the cathode accommodation groove 112 is preferably formed to be slightly larger than the cathode electrode 131.

As described above, since the cathode accommodation groove 112 is formed in a shape corresponding to the cathode electrode 131 and is formed to be slightly larger than the cathode electrode 131, the cathode electrode 131 may be easily coupled to the base portion 100.

In addition, the cathode electrode 131 may be attached to the cathode accommodation groove 112 using brazing or spot welding.

A cathode feed-through hole 114 penetrating to the bottom of the base portion 100 is formed on the bottom of the cathode accommodation groove 112. The cathode feed-through hole 114 may be formed to penetrate vertically downward from the bottom of the cathode accommodation groove 112 to the bottom of the base portion 100.

A cathode power connector 130 for supplying electricity to the cathode electrode 131 is connected through the cathode feed-through hole 114. That is, the cathode power connector 130 is installed through the cathode feed-through hole 114 formed in the base portion 100, and the cathode electrode 131 supported by the cathode accommodation groove 112 is connected to the cathode power connector 130. Thus, power is supplied to the cathode electrode 131 from the outside.

A gate support portion 116 supporting the gate electrode 133 may be formed around the cathode accommodation groove 112 to protrude from the bottom of the cathode accommodation groove 112.

In addition, an inclined surface 113 is formed between the inner surface of the cathode accommodation groove 112 and the gate support portion 116. The inclined surface 113 is formed to increase the insulation distance between the emitter 131*a* and the gate electrode 133 within the limited heights of the base portion 100 and the gate support portion 116, and is formed so as to face the cathode accommodation groove 112 from the gate support portion 116 surrounding the outer circumferential surface of the base portion 100.

That is, when the inclined surface 113 is not formed on the gate support portion 116 forming the cathode accommodation groove 112, an interval (a) between the emitter 131*a* and the gate electrode 133, i.e., a length obtained by subtracting the height of the emitter 131*a* placed on the cathode accommodation groove 112 from the height of the cathode accommodation groove 112, is created in the gate support portion 116 provided on the base portion 100. On the other hand, when the inclined surface 113 is formed on the gate support portion 116, an interval (b) between the emitter 131*a* and the gate electrode 133 is created according to the degree of slope. Accordingly, the interval (b), which is the inclined distance between the emitter 131*a* and the gate support portion 116 in contact with the gate electrode 133, is longer than the interval (a), which is the vertical distance between the emitter 131*a* and the gate electrode 133, i.e., $a<b$.

When the insulation distance between the emitter 131*a* and the gate electrode 133 increases, high current may be applied to the CNT X-ray source apparatus 10, and the lifespan of the CNT X-ray source apparatus 10 may increase.

In addition, a metal thin film 135 that electrically connects the gate electrode 133 and the focusing electrode 134 to each other is provided on the outer side of the upper part of the gate support portion 116. With this configuration, when power is supplied to the focusing electrode 134 through a focusing power connector 132 to be described later, power is supplied to both the focusing electrode 134 and the gate electrode 133 at the same time. That is, in this embodiment, the gate electrode 133 and the focusing electrode 134 share one power connector (the focusing power connector 132) connected to an external power source, and the gate electrode 133 does not require a separate power connector for supplying power.

As described in this embodiment, when the focusing electrode 134, which is one electrode, supplies power to the gate electrode 133, the number of feed-through holes to be formed in the base portion 100 may be reduced, thereby simplifying a process.

A short sill 126 formed on the bottom of the base portion 100 and a short sill formed on the lower part of the CNT X-ray source body 200 are brought into contact with each other so that the CNT X-ray source body 200 is coupled to the base portion 100.

The CNT X-ray source body 200 may be formed in a hollow cylindrical shape and may be formed of an insulating material.

Since short sills each having a shape corresponding to each other are formed in the portion where the base portion 100 and the CNT X-ray source body 200 are coupled, alignment of the CNT X-ray source body 200 may be easy, and thus the CNT X-ray source body 200 may be easily coupled to the base portion 100, thereby enabling mass production and reducing production cost.

A brazing bonding method in which an Ag—Cu alloy braze is heated and used as an adhesive may be applied to one surface where the base portion 100 and the CNT X-ray source body 200 are in contact. However, the present disclosure is not limited to the brazing bonding method, and other bonding methods such as soldering and welding may be used. The coupling relationship between the base portion 100 and the CNT X-ray source body 200 will be described in detail below.

In addition, at least a part of the outer circumferential surface of the base portion 100 may be exposed to a part of the bottom of the CNT X-ray source apparatus 10 and a lower part of the side surface thereof. That is, the bottom of the CNT X-ray source apparatus 10 and a lower part of the side surface thereof may be formed as the outer circumferential surface of the base portion 100. Accordingly, according to the present disclosure, since an electrode does not protrude toward the outside of the CNT X-ray source apparatus 10 and the bottom and side surface of the CNT X-ray source apparatus 10 are formed of insulating materials, insulation may be improved.

FIG. 3 is a perspective view of the base portion of a CNT X-ray source apparatus according to the present disclosure, and FIG. 4 is a cross-sectional view of the base portion of a CNT X-ray source apparatus according to the present disclosure.

The base portion 100 consists of a first body portion 110 for supporting the cathode electrode 131 and the gate electrode 133 and a second body portion 120 for supporting the focusing electrode 134 and the CNT X-ray source body 200. In this case, the first body portion 110 and the second body portion 120 are integrally formed.

As described above, in the first body portion 110, the cathode accommodation groove 112 is formed to be recessed. With this configuration, the first body portion 110 may accommodate the cathode electrode 131. In addition, the cathode feed-through hole 114 penetrating to the bottom of the base portion 100 is formed on the bottom of the cathode accommodation groove 112, and the cathode power connector 130 for supplying electricity to the cathode electrode 131 is connected through the cathode feed-through hole 114.

A focusing electrode support groove 122 into which at least a part of the focusing electrode 134 is inserted is formed in the second body portion 120, and a focusing feed-through hole 124 is formed through the bottom of the focusing electrode support groove 122. The focusing feed-through hole 124 may be formed to penetrate vertically downward from the bottom of the focusing electrode support groove 122 to the bottom of the base portion 100.

In addition, at least one short sill 126 is formed on the second body portion 120, and a lower part of the CNT X-ray source body 200 is coupled to the short sill 126.

The focusing electrode support groove 122 is formed in a recessed ring shape surrounding the first body portion 110, and thus a part of the focusing electrode 134 may be inserted thereinto.

The focusing electrode 134 is formed in a cylindrical shape and is installed in the focusing electrode support groove 122. Power is supplied from the focusing power connector 132 to the focusing electrode 134 through the focusing feed-through hole 124 formed in the bottom of the focusing electrode support groove 122. In this case, as described above, the gate electrode 133 is electrically connected to the focusing electrode 134 by the metal thin film 135 to receive power. In this embodiment, the gate electrode 133 and the focusing electrode 134 share the focusing power connector 132 as a power connector connected to an external power source.

FIGS. 5 and 6 illustrate a CNT X-ray source apparatus according to another embodiment of the present disclosure, FIG. 5 is a cross-sectional view of the CNT X-ray source apparatus according to another embodiment, and FIG. 6 is a cross-sectional view of a base portion included in the CNT X-ray source apparatus according to another embodiment.

The CNT X-ray source apparatus according to another embodiment has a configuration similar to that of the CNT X-ray source apparatus 10 described above, and thus will be described focusing on differences in configuration.

The CNT X-ray source apparatus 20 according to this embodiment is provided with two focusing electrodes 137 and 139. The CNT X-ray source apparatus 20 includes the first focusing electrode 137 and the second focusing electrode 139 provided outside the first focusing electrode 137. In the base portion 100, a first focusing support groove 102 for supporting the first focusing electrode 137 and a second focusing support groove 106 for supporting the second focusing electrode 139 are formed.

Partition walls 109 made of an insulating material are provided between the first focusing electrode 137 and the second focusing electrode 139, a first focusing feed-through hole 104 is formed in the bottom of the first focusing support groove 102 for supporting the first focusing electrode 137, and a second focusing feed-through hole 108 is formed in the bottom of the second focusing support groove 106 for supporting the second focusing electrode 139.

A first focusing power connector 136 is inserted into the first focusing feed-through hole 104 formed in the base portion 100, and a second focusing power connector 138 is inserted into the second focusing feed-through hole 108. In addition, the first focusing electrode 137 and the second focusing electrode 139 are respectively installed at the upper ends of the first focusing support groove 102 and the second focusing support groove 106, the first focusing electrode 137 is connected to the first focusing power connector 136, and the second focusing electrode 139 is connected to the second focusing power connector 138. With this configuration, power may be supplied.

The gate electrode 133 corresponds to the pattern of an emitter and is formed by aligning a mesh sheet having a somewhat large through-hole and a hollow cylinder. In the base portion 100, a gate support groove 117 for supporting the gate electrode 133 is formed in a ring shape, and a gate feed-through hole 128 is formed in the bottom of a gate support groove 113.

The gate electrode 133 is formed to surround the first body portion 110 and is seated in the gate support groove 117. The first focusing electrode 137 and the second focusing electrode 139 are formed of a hollow metal material having a relatively thin thickness, and may be formed in various shapes, such as a hollow cylinder, an oval, and a rectangle, according to a focusing shape, without being limited thereto. In addition, the first focusing electrode 137 and the second focusing electrode 139 may have a shape that facilitates focusing of electron beams, and the second focusing electrode 139 may be formed to have a larger diameter than that of the first focusing electrode 137 so that the second focusing electrode 139 surrounds the first focusing electrode 137.

The first focusing electrode 137 and the second focusing electrode 139 are formed in a hollow shape, i.e., a cylinder shape. Accordingly, compared to a conventional case in which focusing electrodes are laminated on a cathode electrode and a gate electrode, as described above, internal space utilization may be maximized, and thus a withstand voltage may be increased, which enables use of high current. In addition, lifespan may be increased.

However, when two focusing electrodes are arranged side by side as in this embodiment, a function of guiding electrons extracted from the emitter 131*a* to move in one direction without spreading or scattering may be further improved.

In addition, a second focusing electrode upper end portion 139*a* is connected to a second focusing electrode bottom portion 139*b*. The second focusing electrode upper end portion 139*a* and the second focusing electrode bottom portion 139*b* may be formed integrally, or may be formed separately while being connected to each other.

The second focusing electrode upper end portion 139*a* is formed in a cylindrical shape or an elliptical shape and substantially serves as a focusing electrode, and the second focusing electrode bottom portion 139*b* serves to supply electricity to the second focusing electrode upper end portion 139*a*. In addition, the partition walls 109 made of an insulating material are provided between the second focusing electrode 139 and the first focusing electrode 137 to support the first focusing electrode 137 and the second focusing electrode 139 and serve to electrically insulate the first focusing electrode 137 and the second focusing electrode 139 from each other.

The CNT X-ray source apparatus according to the present disclosure can maximize internal space utilization while maintaining the compact outer diameter thereof, which enables use of high current and increases the lifespan thereof.

According to the present disclosure, through feed-through holes formed in a base supporting a cathode electrode, power can be easily supplied to an electrode that is accommodated in a vacuum packaged tube.

According to the present disclosure, a cathode electrode, a gate electrode, a focusing electrode, an X-ray source body, and the like can be easily aligned and coupled, thereby enabling mass production and reducing production cost.

The present disclosure described above is not limited by the above-described embodiments and the accompanying drawings, and it should be understood by those skilled in the art that various substitutions, modifications, and changes can be made without departing from the technical spirit of the present disclosure.

DESCRIPTION OF SYMBOLS

10, 20: CNT X-RAY SOURCE APPARATUS
200: CNT X-RAY SOURCE BODY
100: BASE PORTION
102: FIRST FOCUSING SUPPORT GROOVE
104: FIRST FOCUSING FEED-THROUGH HOLE
106: SECOND FOCUSING SUPPORT GROOVE
108: SECOND FOCUSING FEED-THROUGH HOLE
109: PARTITION WALLS
110: FIRST BODY PORTION
112: CATHODE ACCOMMODATION GROOVE
113: INCLINED SURFACE
114: CATHODE FEED-THROUGH HOLE
116: GATE SUPPORT PORTION
117: GATE SUPPORT GROOVE
120: SECOND BODY PORTION
122: FOCUSING ELECTRODE SUPPORT GROOVE
124: FOCUSING FEED-THROUGH HOLE
126: SHORT SILL
130: CATHODE POWER CONNECTOR
131: CATHODE ELECTRODE
132: FOCUSING POWER CONNECTOR
133: GATE ELECTRODE
134: FOCUSING ELECTRODE
135: METAL THIN FILM
136: FIRST FOCUSING POWER CONNECTOR
137: FIRST FOCUSING ELECTRODE
138: SECOND FOCUSING POWER CONNECTOR
139: SECOND FOCUSING ELECTRODE

What is claimed is:

1. A CNT X-ray source apparatus, comprising:
a cathode electrode;
an emitter provided on the cathode electrode and responsible for emitting electrons;
a gate electrode disposed above the cathode electrode and spaced apart from the cathode electrode by a predetermined interval;
a focusing electrode for preventing scattering of electrons emitted from the emitter; and
a base portion responsible for supporting one or more of the cathode electrode, the gate electrode, and the focusing electrode and formed of an insulating material,
wherein one or more grooves for accommodating at least one of the cathode electrode, the gate electrode, and the focusing electrode are formed in the base portion.

2. The CNT X-ray source apparatus according to claim 1, wherein feed-through holes through which electrodes for supplying electricity to at least one of the cathode electrode, the gate electrode, and the focusing electrode pass are formed through the base portion.

3. The CNT X-ray source apparatus according to claim 1, wherein, on an upper part of the base portion, a cathode accommodation groove for accommodating the cathode electrode is formed to be recessed.

4. The CNT X-ray source apparatus according to claim 3, wherein a cathode feed-through hole penetrating to a bottom of the base portion is formed on a bottom of the cathode accommodation groove, and
a cathode power connector for supplying electricity to the cathode electrode is connected through the cathode feed-through hole.

5. The CNT X-ray source apparatus according to claim 3, wherein a gate support portion for supporting the gate electrode is formed around the cathode accommodation groove to protrude from a bottom of the cathode accommodation groove, and an inclined surface is formed between an inner surface of the cathode accommodation groove and the gate support portion.

6. The CNT X-ray source apparatus according to claim 1, wherein the focusing electrode is formed in a hollow cylindrical shape and is formed to extend upward from the gate electrode.

7. The CNT X-ray source apparatus according to claim 6, wherein the CNT X-ray source apparatus further comprises an X-ray source body supported by the base portion, and the base portion comprises a first body portion for supporting the cathode electrode and the gate electrode and a second body portion for supporting the focusing electrode and the source body, wherein the first body portion and the second body portion are integrally formed.

8. The CNT X-ray source apparatus according to claim 7, wherein a focusing electrode support groove into which at least a part of the focusing electrode is inserted is formed on the second body portion, and a focusing feed-through hole is formed through a bottom of the focusing electrode support groove.

9. The CNT X-ray source apparatus according to claim 8, wherein the focusing electrode support groove is formed in a ring shape surrounding the first body portion.

10. The CNT X-ray source apparatus according to claim 8, wherein a focusing power connector for supplying electricity to the focusing electrode and the gate electrode is connected through the focusing feed-through hole.

11. The CNT X-ray source apparatus according to claim 10, wherein a thin film electrically connecting the gate electrode and the focusing electrode is provided on one side of an upper part of the gate support portion.

12. The CNT X-ray source apparatus according to claim 7, wherein at least one short sill is formed on the second body portion, and the X-ray source body is coupled to the short sill.

13. The CNT X-ray source apparatus according to claim 7, wherein the focusing electrode comprises a first focusing electrode and a second focusing electrode provided outside the first focusing electrode, and a first focusing support groove for supporting the first focusing electrode and a second focusing support groove for supporting the second focusing electrode are formed on the base portion.

14. The CNT X-ray source apparatus according to claim 13, wherein partition walls made of an insulating material are provided between the first focusing electrode and the second focusing electrode, a first focusing feed-through hole is formed on a bottom of the first focusing electrode support groove, and a second focusing feed-through hole is formed on a bottom of the second focusing electrode support groove.

15. The CNT X-ray source apparatus according to claim 14, wherein the gate electrode is formed in a hollow cylindrical shape, a ring-shaped gate support groove for supporting the gate electrode is formed on the first body portion, and gate electrode feed-through holes are formed on a bottom of the gate support groove for supporting the gate electrode.

16. The CNT X-ray source apparatus according to claim 1, wherein at least a part of an outer circumferential surface of the base portion is exposed to a part of a bottom of the CNT X-ray source apparatus and a lower part of a side surface of the CNT X-ray source apparatus.

17. A CNT X-ray source apparatus, comprising:

a cathode electrode;

an emitter provided on the cathode electrode and responsible for emitting electrons;

a gate electrode disposed above the cathode electrode and spaced apart from the cathode electrode by a predetermined interval;

a focusing electrode for preventing scattering of electrons emitted from the emitter;

a base portion responsible for supporting one or more of the cathode electrode, the gate electrode, and the focusing electrode and formed of an insulating material; and an X-ray source body responsible for accommodating the cathode electrode, the emitter, the gate electrode, and the focusing electrode and supported by the base portion, wherein one or more feed-through holes for supplying electricity to at least one of the cathode electrode, the gate electrode, and the focusing electrode are formed on the base portion, and one or more short sills that facilitate engagement with the cathode electrode, the gate electrode, the focusing electrode, and the X-ray source body are formed on the base portion.

* * * * *